US007267617B2

(12) United States Patent
Shui-Mu

(10) Patent No.: US 7,267,617 B2
(45) Date of Patent: Sep. 11, 2007

(54) RAIL STRUCTURE FOR POCKET BILLIARD TABLE

(76) Inventor: Chen Shui-Mu, No. 185, Yuan-Id Rd. Sec. 4, Hsiliao Li, Hsihu.Changhua (TW)

( * ) Notice: Subject to any disclaimer, the term of this patent is extended or adjusted under 35 U.S.C. 154(b) by 35 days.

(21) Appl. No.: 11/273,783

(22) Filed: Nov. 14, 2005

(65) Prior Publication Data

US 2007/0111810 A1 May 17, 2007

(51) Int. Cl.
*A63D 15/00* (2006.01)

(52) U.S. Cl. ..... 473/31; 473/32

(58) Field of Classification Search ..... 473/1, 473/28, 30, 31, 32, 11–13
See application file for complete search history.

(56) References Cited

U.S. PATENT DOCUMENTS 1,213,950 A * 1/1917 Ringsmith ..... 473/32
1,652,671 A * 12/1927 Hoskin ..... 473/32
3,138,387 A * 6/1964 Michel et al. ..... 473/159
3,489,410 A * 1/1970 Petras et al. ..... 473/28
3,729,192 A * 4/1973 Nielsen ..... 473/30
4,508,338 A * 4/1985 Kremski ..... 473/32
4,579,342 A * 4/1986 Mortensen ..... 473/3

* cited by examiner

*Primary Examiner*—Mitra Aryanpour
(74) *Attorney, Agent, or Firm*—Charles E. Baxley

(57) ABSTRACT

A hollow rail structure directly extruded from aluminum in for pocket billiard table is disclosed to have an inner sidewall, an outer sidewall, a top wall, a bottom wall, ribs that define the inside space of the hollow rail into multiple compartments, a cover cloth locating groove longitudinally disposed on the top wall adjacent to the inner sidewall for the positioning of one side of a cover cloth, a longitudinal inside bottom channel longitudinally disposed inside the bottom wall adjacent to the inner sidewall for holding a wooden block for the mounting of the other side of the cover cloth and is fastened to the cover cloth locating groove, a longitudinal inside top channel formed inside the top wall, and a plurality of top locating holes in communication with the inside top channel and the outside space for the mounting of sights.

18 Claims, 4 Drawing Sheets

RAIL STRUCTURE FOR POCKET BILLIARD TABLE

BACKGROUND OF THE INVENTION

1. Field of the Invention

The present invention relates to a pocket billiard table and more particularly to a rail structure for pocket billiard table.

2. Description of the Related Art

A conventional pocket billiard table, as shown in FIG. 1, comprises a rectangular tabletop 10, a plurality of rails 11 respectively arranged along the four sides of the table 10, four corner fittings 12 respectively disposed in the four corners of the tabletop 10 and connected between each two adjacent rails 11 and defining with the tabletop 10 a respective pocket 14, and four legs 130 respectively provided at the bottom side of the table 10.

Referring to FIGS. 2 and 3, each rail 11 is formed of a number of wooden blocks 13 that are bonded to one another with glue. Further, each rail 11 has an inner sidewall 15, which is abutted against the tabletop 10 and has an upper sloping surface portion 151 and a lower sloping surface portion 152, a rubber cushion strip 36 bonded to the upper sloping surface portion 151 for stopping against the ball during the game, an outer sidewall 16 opposite to the inner sidewall 15, a locating groove 161 longitudinally formed in the outer sidewall 16 on the middle, a top wall 17 smoothly curved downwards from the topmost edge of the inner sidewall 15 toward the outer sidewall 16 and covered with a layer of ornamental covering 18, and a packing strip 19 fastened to the locating groove 161 and covered on the outer sidewall 16 for protection.

The top wall 17 has a locating groove 171 for the positioning of a locating block 172 to hold down one side of a cover cloth 173, which is covered over the rubber cushion strip 36 and has the other side affixed to the bottom side of the rail 11 by fastening members 174 (for example, nails).

After covering of the ornamental covering 18 on the top wall 17 of the rail 11, holes 111 are formed on the ornamental covering 18 and the top wall 17 of the rail 11, and then sights 112 are affixed to the holes 111 for reference in counting the ball striking angle. The rail 11 further has a plurality of bottom mounting holes 113 for fastening to the table 10 with fastening members.

The aforesaid structure of rail 11 has numerous drawbacks as follows:

1. Because the wooden blocks 13 that form each rail 11 have different density, the rails 11 vary in density. When the ball hits the rubber cushion strip 36, the respective rail 11 gives a different reactive force. This problem affects the ball control and the bouncing speed and direction of the ball.

2. The wooden blocks 13 of the rails 11 may deform due to a significant environmental temperature or humidity change. A deformed rail 11 makes aforesaid problem more serious.

3. The curvature of the top wall 17, the upper sloping surface portion 151 and lower sloping surface portion 152, the locating grooves 161 and 171 and the holes 111 of each rail 11 complicate the fabrication of the rails 11.

4. The consumption of wooden material threatens the ecological environment. It is against environmental protection to fell trees for making pocket billiards tables.

SUMMARY OF THE INVENTION

The present invention has been accomplished under the circumstances in view. It is one object of the present invention to provide a rail structure for pocket billiard table, which has a strong structure and uniform density, enabling the player to accurately control the ball striking force and the bounding speed and direction of the ball. It is another object of the present invention to provide a rail structure for pocket billiard table, which does not deform or break during a significant environmental temperature of humidity change. It is still another object of the present invention to provide a rail structure for pocket billiard table, which is practical for production through a standard manufacturing process to reduce the cost. It is still another object of the present invention to provide a rail structure for pocket billiard table, which can be cut into different lengths to fit different requirements. It is still another object of the present invention to provide a rail structure for pocket billiard table, which uses a reclaimable material to prevent waste of natural resources. It is still another object of the present invention to provide a rail structure for pocket billiard table, which has a strong structural strength, and does not deform or break when the player puts the body weight on it during the game.

To achieve these and other objects of the present invention, the rail structure for pocket billiard table comprises a hollow rail body extruded from aluminum. The rail body has an inner sidewall, an outer sidewall opposite to the inner sidewall, a top wall connected between said inner sidewall and the outer sidewall at a top side, a bottom wall connected between the inner sidewall and the outer sidewall at a bottom side opposite to the top wall, a plurality of ribs that define the inside space of the hollow rail body into a plurality of compartments, a cover cloth locating groove longitudinally disposed on the top wall adjacent to the inner sidewall for the positioning of a cover cloth, a longitudinal inside bottom channel longitudinally disposed inside the bottom wall adjacent to the inner sidewall, and a longitudinal slot in communication between longitudinal inside bottom channel and the outside space, a longitudinal inside top channel formed inside said top wall, and a plurality of top locating holes in communication with the inside top channel and the outside space for the mounting of sights.

DETAILED DESCRIPTION OF THE PREFERRED EMBODIMENT

Figure 1:
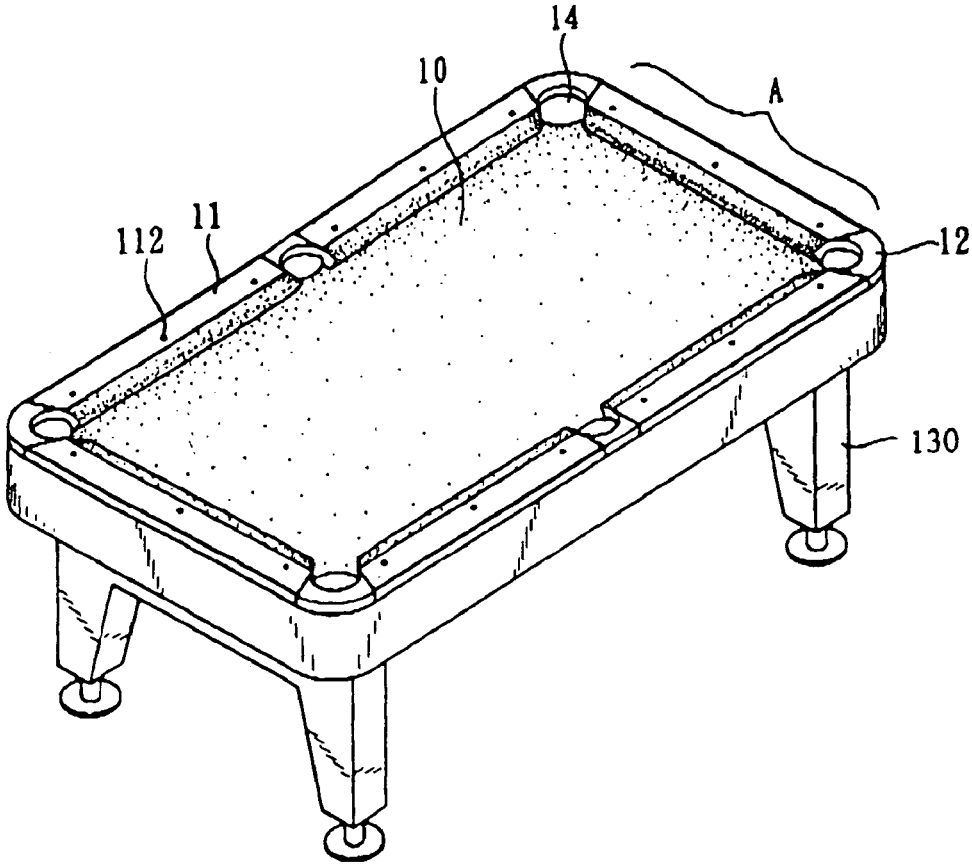
FIG. 1 PRIOR ART
FIG. 1 is an elevational view of a pocket billiard table according to the prior art.
Figure 2:
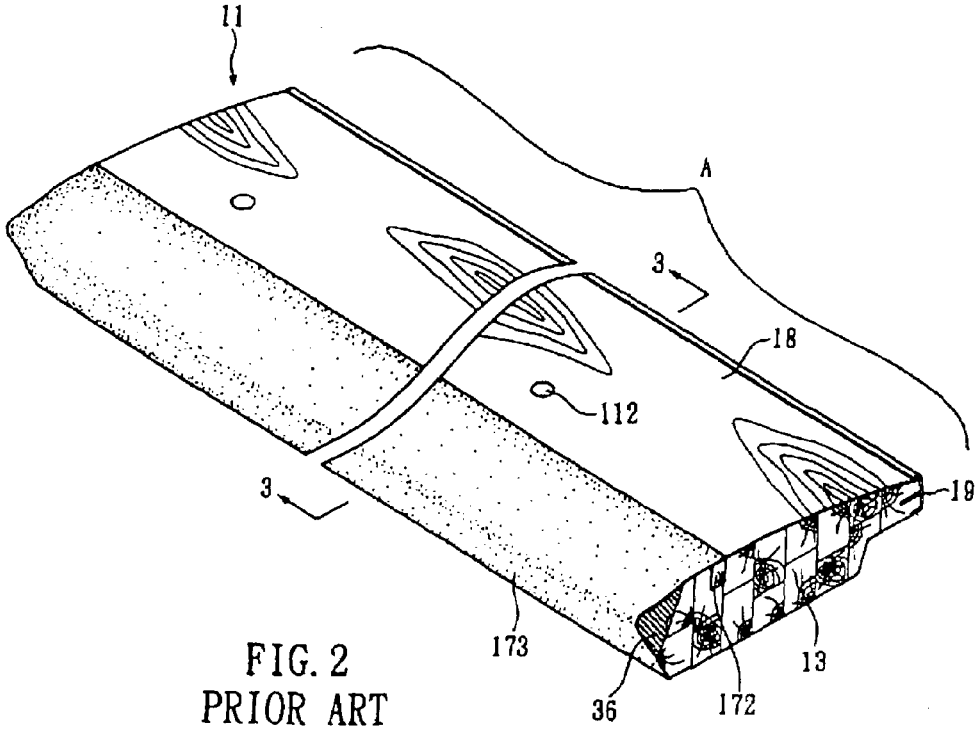
FIG. 2 PRIOR ART
FIG. 2 is an elevational view in an enlarged scale of part A of FIG. 1.
Figure 3:
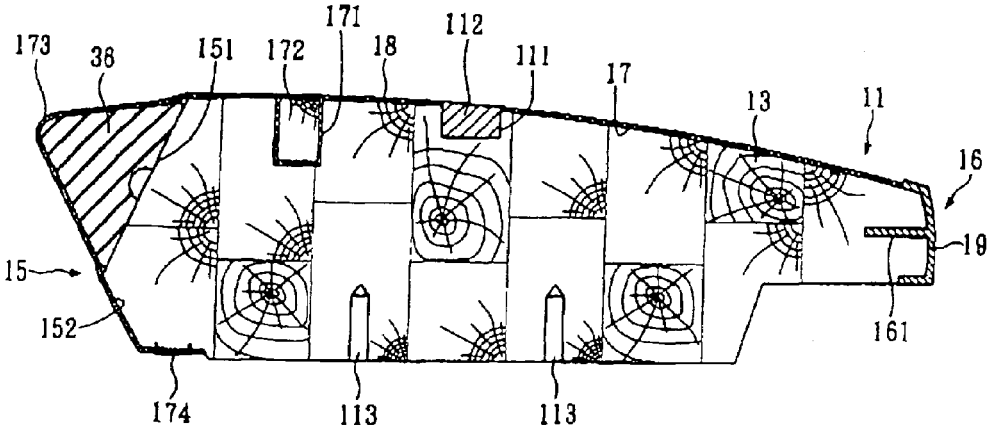
FIG. 3 PRIOR ART
FIG. 3 is a sectional view taken in an enlarged scale along line 3-3 of FIG. 2.
Figure 4:
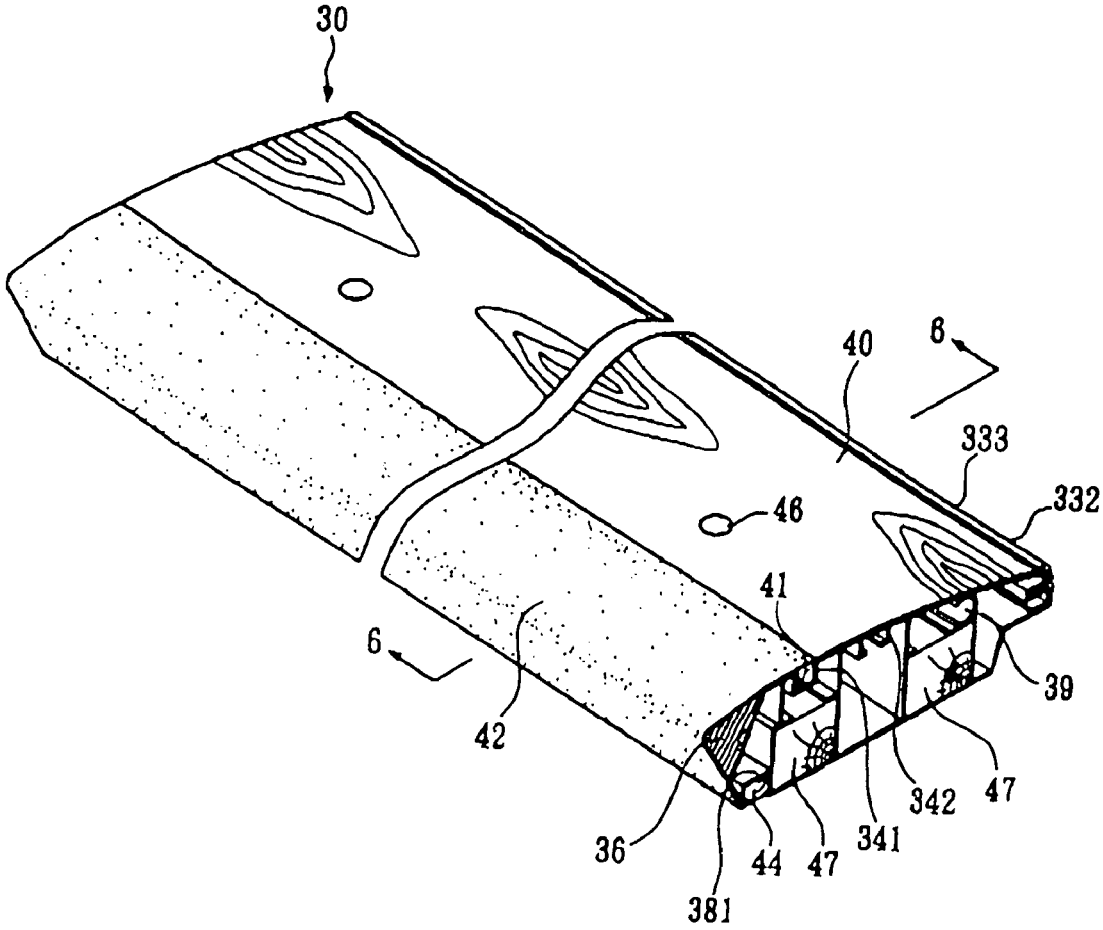
FIG. 4 is an elevational view of a rail for pocket billiard table according to the present invention.
Figure 5:
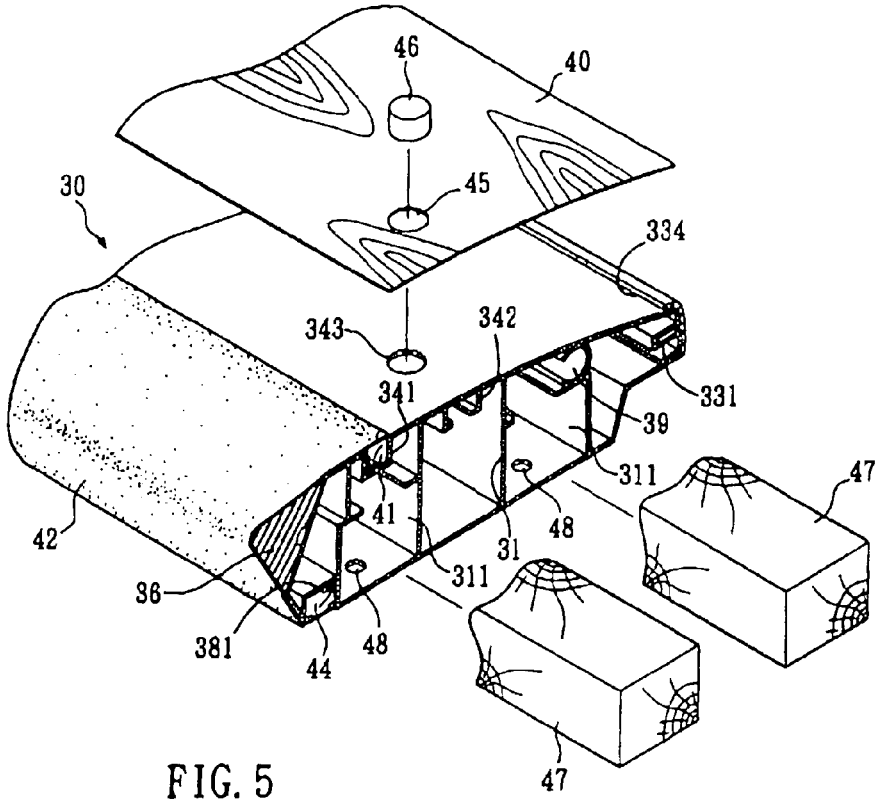
FIG. 5 is an exploded view in an enlarged scale of the rail for pocket billiard table shown in FIG. 4.
Figure 6:
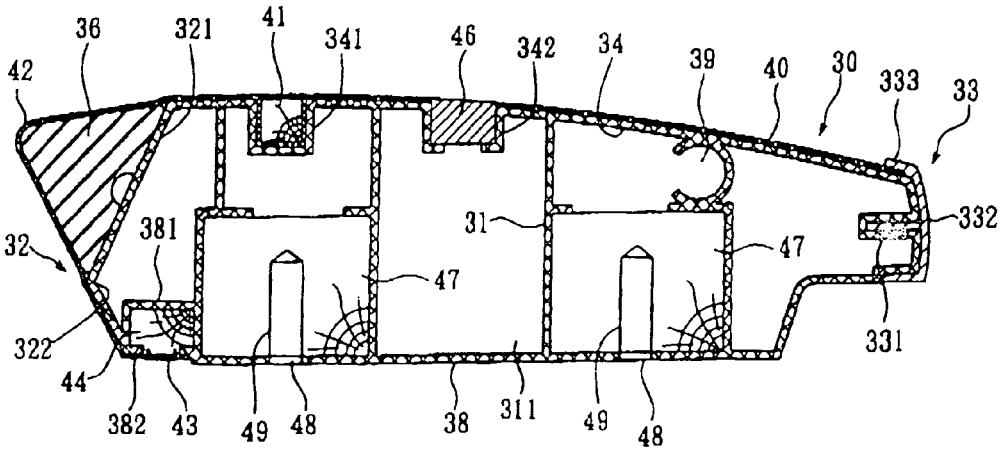
FIG. 6 is a sectional view taken in an enlarged scale along line 6-6 of FIG. 4.

Referring to FIG. 4~6, a rail 30 for pocket billiard table in accordance with the present invention is extruded from aluminum, i.e., aluminum is heated to temperature about 400° C.~500° C. and then extruded into the desired rail 30 through an extruding die in an extruding machine.

Referring to FIGS. 4~6 again, the rail 30 is a hollow bar having an inner sidewall 32, an outer sidewall 33 opposite to the inner sidewall 32, a top wall 34 connected between the inner sidewall 32 and the outer sidewall 33 at the top side, a bottom wall 38 connected between the inner sidewall 32 and the outer sidewall 33 at the bottom side opposite to the top wall 34, and a plurality of ribs 31 that define the inside space of the rail 30 into a plurality of compartments 311. The inner sidewall 32 is a double-beveled wall having an upper sloping surface portion 321 and a lower sloping surface portion 322. The outer sidewall 33 has a locating groove 331 longitudinally disposed on the middle. The top wall 34 has a locating groove 341 longitudinally disposed adjacent to the upper surface portion 321 of the inner sidewall 32. The bottom wall 38 has a longitudinal inside channel 381 longitudinally disposed adjacent to the lower surface portion 322 of the inner sidewall 32, and a longitudinal slot 382 in communication between the longitudinal channel 381 and the outside space. The top wall 34 has a longitudinal inside channel 342, and a plurality of top locating holes 343 in communication with the inside channel 342 and the outside space. Further, a locating hole 39 is provided inside the rail 30 at a suitable location.

A rubber cushion strip 36 is bonded to the upper surface portion 321 of the inner sidewall 32. A packing strip 332 is fastened to the locating groove 331 and covered over the outer sidewall 33, having a top edge 333 extending to the top wall 34 and defining with the top wall 34 a longitudinally extending gap 334. An ornamental covering 40 is bonded to the top wall 34, having one long side engaged into the gap 334 and the other long side abutted against one side of the locating groove 341. A locating block 41 is fastened to the locating groove 341 to hold down one side of a cover cloth 42. A solid member, for example, a wooden block 44 is press-fitted into the longitudinal inside channel 381 in the bottom wall 38. Fastening members 43 are mounted in the longitudinal slot 382 and affixed to the wooden block 44 to affix the other side of the cover cloth 42, keeping the cover cloth 42 covered over the whole area of the rubber cushion strip 36. Further, the top edge 333 can stop a chalk on the ornamental covering 40, preventing fall of the chalk from the rail 30.

The ornamental covering 40 has holes 45 corresponding to the top locating holes 343 of the top wall 34. Sights 46 are fastened to the holes 45 of the ornamental covering 40 and the respective top locating holes 343 of the top wall 34 and the inside channel 342 for reference in counting the ball-striking angle.

Solid materials, for example, wooden blocks 47 are fitted into the compartments 311 to increase the weight of the rail 30. Further, mounting holes 48 and 49 are respectively formed on the bottom wall 38 and the wooden blocks 47 for fastening to the table top of the pocket billiard table (not shown) with fastening members (not shown).

Further, the aforesaid locating hole 39 is provided for the connection of the rail 30 with another rail or a corner fitting of the pocket billiard table.

The rail 30 for pocket billiard table according to the present invention has the following advantages:

1. Because the main body of the rail 30 is directly extruded from aluminum, it has a strong structure and uniform density. All the rails of the pocket billiard table made according to the present invention have the same density and provide an equal reactive force. Therefore, the player can accurately control the ball striking force and the bouncing speed and direction of the ball.

2. Because the rail is directly extruded from aluminum, it does not deform during a significant environmental temperature or humility change.

3. By means of aluminum extrusion, the inner sidewall 32, outer sidewall 33, top wall 34, upper sloping surface portion 321, lower sloping surface portion 322, locating grooves 331 and 341, inside channel 342 and 381, and compartments 311 of the rail 30 are simultaneously formed after the extruding process. Therefore, the rail 30 can be made through a standard manufacturing process to reduce the cost.

4. The use of aluminum material for the rail 30 does not threaten the ecological environment. Further, aluminum material is reclaimable to prevent waste of natural resources.

5. After extrusion, the aluminum profile (rail) can be cut into different lengths to fit different requirements.

6. Because the rail 30 is extruded from aluminum, it has a light weight and strong structural strength. The rail 30 does not deform or break when the player puts the body weight on it.

Although a particular embodiment of the invention has been described in detail for purposes of illustration, various modifications and enhancements may be made without departing from the spirit and scope of the invention.

What the invention claimed is:

1. A rail structure for pocket billiard table, comprising a hollow rail body extruded from aluminum, said rail body having an inner sidewall, an outer sidewall opposite to said inner sidewall, a top wall connected between said inner sidewall and said outer sidewall at a top side, a bottom wall connected between said inner sidewall and said outer sidewall at a bottom side opposite to said top wall, a plurality of ribs that define the inside space of said hollow rail body into a plurality of compartments, a cover cloth locating groove longitudinally disposed on said top wall adjacent to said inner sidewall for the positioning of a cover cloth, a longitudinal inside bottom channel longitudinally disposed inside said bottom wall adjacent to said inner sidewall, and a longitudinal slot in communication between longitudinal inside bottom channel and the outside space, a longitudinal inside top channel formed inside said top wall, and a plurality of top locating holes in communication with said inside top channel and the outside space for the mounting of sights.

2. The rail structure as claimed in claim 1, wherein said inner sidewall is a double-beveled wall having an upper sloping surface portion and a lower sloping surface portion.

3. The rail structure as claimed in claim 2, further comprising a rubber cushion strip bonded to said upper sloping surface portion of said inner sidewall.

4. The rail structure as claimed in claim 1, wherein said outer sidewall has a longitudinally extended locating groove for the mounting of a packing strip.

5. The rail structure as claimed in claim 4, further comprising a packing strip fastened to the longitudinally extended locating groove at said outer sidewall and covered over said outer sidewall.

6. The rail structure as claimed in claim 5, wherein said packing strip has a top side edge extending to said top wall.

7. The rail structure as claimed in claim 6, wherein the top side edge of said edge of said packing strip defines with said top wall a gap.

8. The rail structure as claimed in claim 7, further comprising an ornamental covering covered on said top wall, said ornamental covering having a first side engaged into the gap between said top side edge of said packing strip and said top wall and a second side extending to one side of said cover cloth locating groove.

9. The rail structure as claimed in claim 1, wherein said top wall has a plurality of locating holes respectively disposed in communication with said longitudinal top inside channel for the mounting of sights.

10. The rail structure as claimed in claim 9, further comprising an ornamental covering bonded to said top wall, said ornamental covering having a plurality of holes corresponding to the locating holes at the top wall for the mounting of sights.

11. The rail structure as claimed in claim 10, further comprising a plurality of sights respectively mounted in the holes of said ornamental covering and the locating holes at said top wall and exposed to the outside of said ornamental covering.

12. The rail structure as claimed in claim 1, wherein said bottom wall has a longitudinal slot disposed in communication with said longitudinal bottom inside channel.

13. The rail structure as claimed in claim 12, further comprising a solid material fitted into said longitudinal bottom inside channel.

14. The rail structure as claimed in claim 13, further comprising a cover cloth covered on said rubber cushion strip, said cover cloth having a first side affixed to said cover cloth locating groove with a locating block and a second side affixed to the solid material in said longitudinal bottom inside channel.

15. The rail structure as claimed in claim 13, the solid material in said longitudinal bottom inside channel is a wooden block.

16. The rail structure as claimed in claim 1, further comprising a solid material fitted into said compartments in said rail body and abutted against said bottom wall for mounting.

17. The rail structure as claimed in claim 16, wherein the solid material that is fitted into said compartments in said rail body is comprised of at least one wooden block, said at least one wooden block having a plurality of bottom mounting holes; said bottom wall has a plurality of bottom mounting holes corresponding to the bottom mounting holes of the at least one wooden block in said compartments for mounting.

18. The rail structure as claimed in claim 1, wherein said rail body has at least one locating hole extending through two distal ends thereof for mounting.

* * * * *